US007620355B2

(12) United States Patent
Tamura et al.

(10) Patent No.: US 7,620,355 B2
(45) Date of Patent: Nov. 17, 2009

(54) GLOSSINESS PROCESSING APPARATUS AND IMAGE FORMING APPARATUS

(75) Inventors: Masashige Tamura, Toride (JP); Ryuichi Ibe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 470 days.

(21) Appl. No.: 11/460,395

(22) Filed: Jul. 27, 2006

(65) Prior Publication Data

US 2007/0025782 A1 Feb. 1, 2007

(30) Foreign Application Priority Data

Aug. 1, 2005 (JP) ..... 2005-223277
Jul. 21, 2006 (JP) ..... 2006-199757

(51) Int. Cl.
*G03G 15/20* (2006.01)

(52) U.S. Cl. ..... 399/322; 399/341; 399/407

(58) Field of Classification Search ..... 399/322, 399/341, 407
See application file for complete search history.

(56) References Cited

U.S. PATENT DOCUMENTS 6,567,640 B2 5/2003 Ishikawa et al. ..... 399/329
6,615,018 B2 9/2003 Funato ..... 399/322
6,618,573 B2 9/2003 Ishikawa et al. ..... 399/328
6,771,926 B2 8/2004 Ishikawa et al. ..... 399/329
6,853,832 B2 2/2005 Noya et al. ..... 399/328
2003/0180063 A1 * 9/2003 Kanesawa et al. ..... 399/69
2005/0069354 A1 * 3/2005 Nakamura et al. ..... 399/341

FOREIGN PATENT DOCUMENTS

JP 5-216322 8/1993
JP 2002-99168 4/2002
JP 2003-005545 1/2003
JP 2004-151201 5/2004

* cited by examiner

*Primary Examiner*—David M Gray
*Assistant Examiner*—Bryan P Ready
(74) *Attorney, Agent, or Firm*—Fitzpatrick, Cella, Harper & Scinto

(57) ABSTRACT

A fixing apparatus in which a sheet on which a toner image is fixed in a first heating portion is conveyed to a second heating portion through a first conveying path, the conveyed sheet is re-fixed in the second heating portion, and the re-fixed sheet is conveyed through a second conveying path having a curved guide surface. The first conveying path, the second heating portion, and the second conveying path are arranged from above downward in order of mention, and the sheet re-fixed in the second conveying path is allowed to pass so that a surface opposite to a surface on which the image is fixed moves along the guide surface.

18 Claims, 12 Drawing Sheets

GLOSSINESS PROCESSING APPARATUS AND IMAGE FORMING APPARATUS

BACKGROUND OF THE INVENTION

1. Field of the Invention

The present invention relates to a glossiness processing apparatus, and more particularly, to a glossiness processing apparatus that performs glossiness processing for forming an image of high glossiness on a sheet.

2. Description of the Related Art

In recent years, color images have been formed for increasingly diverse purposes, and hence, image forming apparatuses such as a color printer, a color copying machine, a facsimile, and a compound machine using a digital electrophotographic printing method are spreading widely. Further, recently, the quality of the color image has been enhanced, so the image forming apparatuses is widely used more often for outputting an image of a digital still camera whose recent spread on the market is prominent.

Under such circumstances, as image forming apparatuses such as a printer and a copying machine using the electrophotographic printing method or the like, there is a demand for those capable of outputting an image of high-glossiness quality comparable to that of a silver halide photography, as well as outputting an image of ordinary quality.

As an example of an image forming method of obtaining a color image of high glossiness, for example, there is a method as described in Japanese Patent Application Laid-open No. H05-216322. According to this method, a sheet serving as a transfer material travels below a member containing a heat source by a belt-shaped conveying member, whereby color toner adhering to a transparent resin layer made of a thermoplastic resin on a sheet surface is heated to melt the color toner in the transparent resin layer. Next, the color toner is cooled to be fixed on the sheet, whereby an image is formed. After the color image is thus formed, the sheet is separated from the belt-shaped conveying member.

In the high-gloss image forming method, as described in Japanese Patent Application Laid-open No. 2002-99168, the belt-shaped conveying member bringing a sheet into contact therewith is positioned below the sheet while the sheet is brought into contact with the belt-shaped conveying member. It has also been proposed that the belt-shaped conveying member be positioned above the sheet.

Further, as a configuration of an image forming apparatus capable of obtaining a color image of high glossiness adopting such a method, there is a configuration in which in addition to a fixing portion (hereinafter, referred to as a first heating portion) for performing ordinary fixing processing, a second heating portion having a belt-shaped conveying member are provided. The second heating portion heats again a sheet fixed by the first heating portion, whereby an image of high glossiness is obtained.

In this case, for example, as described in Japanese Patent Application Laid-open No. 2004-151201 and Japanese Patent Application Laid-open No. 2003-005545, an external processing apparatus provided with a second heating portion serving as a re-heating processing system is connected to the image forming apparatus. Further, a small fixing portion having a belt-shaped conveying member of a photographic size may be provided in a space of a sheet discharging portion (so-called in-body sheet discharging portion) between an image forming portion and an image reading portion of the image forming apparatus.

In this case, the external processing apparatus having the second heating portion passes through an ordinary image forming process, and receives a sheet discharged after being fixed by the first heating portion of the image forming apparatus. In a case where an image of high glossiness is selected, the external processing apparatus performs re-heating processing. When such an external processing apparatus receives a sheet, the external processing apparatus conveys the sheet to the second heating portion having a belt-shaped conveying member through a branch path provided inside, in the case where an image of high glossiness is selected.

Then, the external processing apparatus heats and presses the sheet conveyed to the second heating portion with heating means and pressing means under the condition that a high-glossiness formation surface is in contact with a belt surface of the belt-shaped conveying member, thereby discharging the sheet with an image of high glossiness formed thereon. In the case where an image of high glossiness is not selected, the external processing apparatus switches the branch path to a discharging tray side, thereby discharging the sheet without performing any other process.

In a conventional image forming apparatus with such the second heating portion, for example, in a case where the second heating portion is mounted to an in-body sheet discharging portion, a system configuration can be realized in which an image of high quality made of a high-gloss image is obtained without enlarging the mounting area of the image forming apparatus. However, in the case where the second heating portion is set in the in-body sheet discharging portion, the second heating portion needs to be downsized, and in this case, the size of a sheet that can be fixed is limited, which makes it difficult to receive sheets of various sizes.

On the other hand, in a case where a separate external processing apparatus is attached to an image forming apparatus, a second heating portion having a belt-shaped conveying member can be enlarged. Therefore, glossy images of various sizes can be obtained. However, in this external processing apparatus, a conveying path is placed horizontally, so there is a problem that the width in a sheet conveying direction of the fixing apparatus becomes large to enlarge the apparatus and widen the setting area. In particular, as the belt-shaped conveying member is made longer so as to enlarge the second heating portion, the apparatus is more enlarged.

SUMMARY OF THE INVENTION

The present invention has been achieved in view of the above-mentioned circumstance, and therefore has an object to provide a fixing apparatus capable of forming an image of high glossiness as well as suppressing the enlargement of the apparatus even in the case where a second heating portion is provided.

According to one aspect of the present invention, a fixing apparatus includes: a first heating portion configured to heat a sheet with a toner image transferred thereon; a second heating portion configured to heat the sheet on which the toner image is fixed in the first heating portion; a first conveying path configured to guide the sheet on which the toner image is heated in the first heating portion to the second heating portion; and a second conveying path configured to guide the sheet from the second heating portion to a downstream side, wherein the first conveying path, the second heating portion, and the second conveying path are placed from above downward in order of mention, the second conveying path has a curved guide surface, and when the sheet on which the toner image is heated in the second heating portion is guided by the second conveying path, the sheet is guided so that a surface opposite to a surface on which the toner image is transferred moves along the curved guide surface.

Further features of the present invention will become apparent from the following description of exemplary embodiments (with reference to the attached drawings).

DESCRIPTION OF THE EMBODIMENTS

Hereinafter, the present invention will be described in detail by way of the best embodiments with reference to the accompanying drawings.

Figure 1:
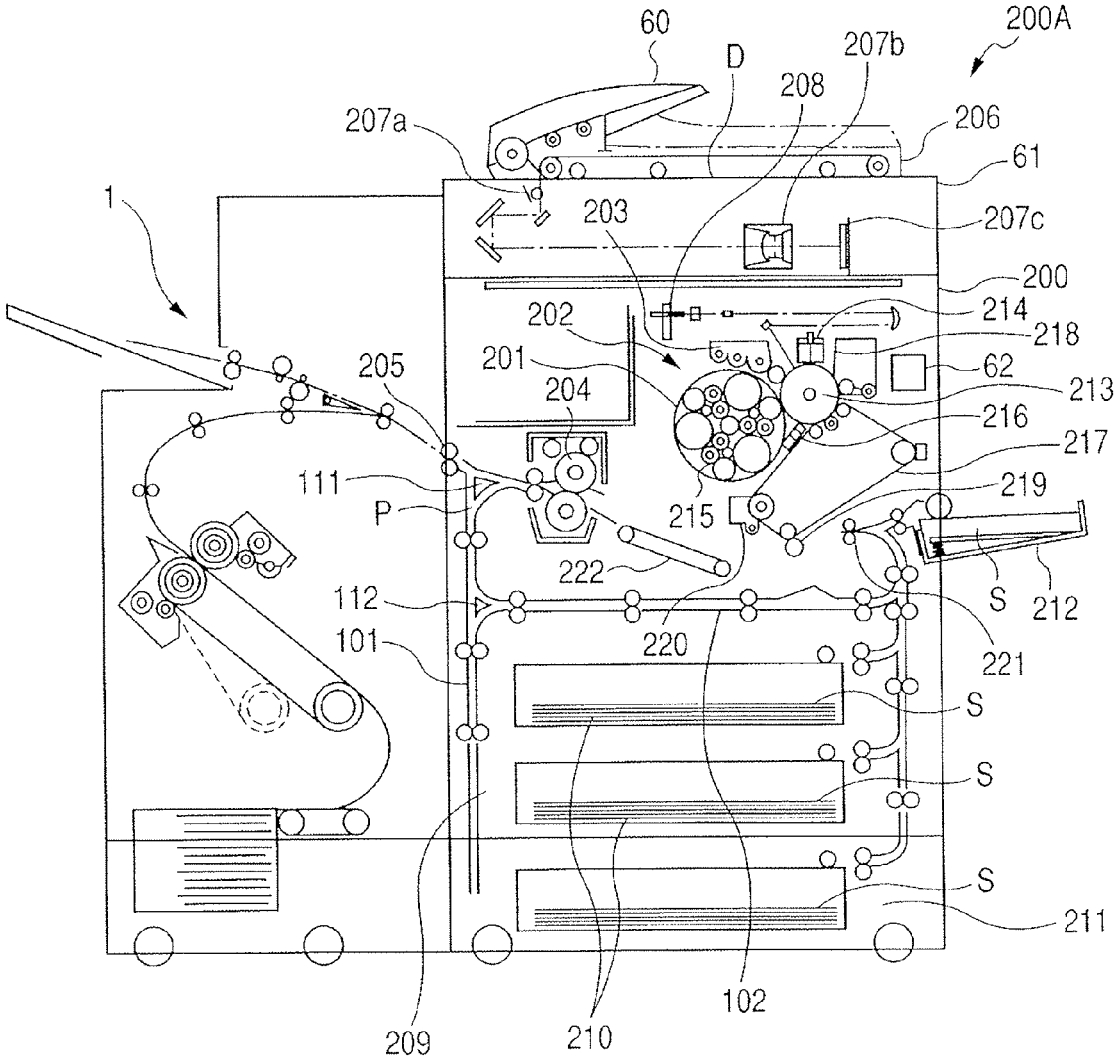
FIG. 1 is a view showing a schematic configuration of a color copying machine that is an exemplary image forming apparatus of a first embodiment according to the present invention.

FIG. 1 is a view showing a schematic configuration of a color copying machine that is an exemplary image forming apparatus of a first embodiment according to the present invention.

In FIG. 1, reference symbol 200A denotes a color copying machine, and 200 denotes a color copying machine body (hereinafter, referred to as an apparatus main body). In an upper portion of the apparatus main body 200, there is provided an image reading portion 61 for reading an original D sent to an original plate (platen glass) 206 serving as an original placement stand by an automatic original feeding device 60. In an image reading portion 61, a light source 207*a*, a lens system 207*b*, and a CCD unit 207*c* are provided.

Further, an image forming portion 202 and a sheet feeding portion 209 for feeding a sheet S to the image forming portion 202 are provided below the image reading portion 61. Further, on one side of the apparatus main body 200, the external processing apparatus 1 for re-heating a sheet on which an image is formed discharged from the apparatus main body 200 is provided detachably.

Herein, in the image forming portion 202, there are provided a photosensitive drum 213, a primary charger 214, a black developing unit 203 configured independently, a rotary developing unit 201 containing a plurality of developing units 215 integrated with a toner cartridge, and a post charger 216 for adjusting image quality after development. Further, in the image forming portion 202, there are provided an endless transferring belt 217 for transferring toner images of four colors in a layered state to form an image before transferring a multi-color image to the sheet S, and a secondary transferring roller 219 for transferring a toner image from a transferring belt 217 to the sheet S. A drum cleaner 218 removes toner remaining on the photosensitive drum 213. The belt cleaner 220 removes toner remaining on the transferring belt 217.

Further, the sheet feeding portion 209 is provided with cassettes 210 and 211 containing the sheet S and being attachable/detachable with respect to the apparatus main body 200, and a manual cassette 212. The sheet S is sent from the cassettes 210 and 211 and the manual cassette 212 to the image forming portion 202.

On an upstream side of the image forming portion 202, a registration roller 221 for enhancing an attitude position precision of the sheet S and sending the sheet S in accordance with the toner image on the transferring belt at a good timing is provided. Further, on a downstream side of the image forming portion 202, a transfer conveying apparatus 222 for conveying the sheet S with the toner image transferred thereon, a first heating portion 204 for heating an unfixed image on the sheet, a pair of delivery rollers 205 for discharging the sheet S with the image fixed thereon outside the apparatus main body, and the like are provided. Further, the control device 62 controls the entire image forming operation of the apparatus main body 200.

Next, the operation of the color copying machine 200A with such the configuration will be described.

When a sheet feed signal is output from a control device 62 provided in the apparatus main body 200, for example, an original D sent onto the original plate 206 by the automatic original feeding device 60 is irradiated with light from the light source 207*a*, and reflects the light. The light reflected from the original D is once read by the CCD unit 207*c* via the lens system 207*b* to be converted to an electric signal, and the photosensitive drum 213 is irradiated with laser light corresponding to the electric signal from a laser scanner unit 208.

At this time, the photosensitive drum 213 is previously charged by the primary charger 214, and irradiated with light, whereby an electrostatic latent image is formed. Then, a toner image of selected colors is formed by the black developing unit 203 and the plurality of developing units 215 provided in the rotary developing unit 201. After that, a potential of the toner image formed on the photosensitive drum 213 is adjusted by a post charger 216, and the toner image is transferred onto the transferring belt 217 at a transfer position.

Herein, in the case of a color mode, the transferring belt 217 with the toner image transferred thereon further rotates so that a subsequent toner image is formed and transferred. During this time, the rotary developing unit 201 rotates the developing unit of a subsequently specified color in a counterclockwise direction so that the developing unit is set opposed to the photosensitive drum 213, thereby preparing for the development of a subsequent electrostatic latent image. Thus, in a full-color mode, the formation, development, and transfer of an electrostatic latent image are repeated until a predetermined number of toner images are transferred.

On the other hand, when a sheet feed signal is output from the control device 62, the sheet S is fed from the cassettes 210 and 211 or the manual cassette 212. After that, the sheet S fed from the sheet feeding portion 209 is corrected for skew feed by the registration roller 221, and adjusted for timing, thereby being sent to a secondary transferring portion composed of the transferring belt 217 and the secondary transferring roller 219.

Next, the sheet S sent to the secondary transferring portion has a toner image transferred thereon by the secondary transferring roller 219, and is conveyed to the first heating portion 204 by the transfer conveying apparatus 222. After that, the sheet S is heated and pressed by the first heating portion 204, whereby an unfixed transfer image is permanently fixed on the sheet S.

Then, the sheet S with an image fixed thereon is discharged by the delivery roller 205 from the apparatus main body 200 to the external processing apparatus 1. Thus, the sheet S fed from the sheet feeding portion 209 is discharged with an image being formed thereon.

The color copying machine 200A has a double-sided image forming function, and hereinafter, the double-sided image forming operation, mainly, the conveying state of the sheet S will be described. The sheet S after having undergone the fixing processing of a first surface by the first heating portion 204 as described above is first branched downward by an inversion flapper mechanism 111, conveyed to an inversion conveying path 101 placed on a downstream side of an inversion branch point P, and switch-back inverted by the inversion conveying path 101.

Next, the sheet S switch-back inverted by the inversion conveying path 101 is attracted to a double-sided conveying path 102 by a double-sided flapper mechanism 112 in an inverted state, and conveyed again toward the image forming portion 202 through the registration roller 221. Then, the sheet S conveyed again to the image forming portion 202 has a toner image formed on a second surface by the image forming process as described above. If the sheet S is discharged by a delivery roller 205 in an inverted state from the inversion conveying path 101, the sheet S is discharged in the inverted state.

Figure 2:
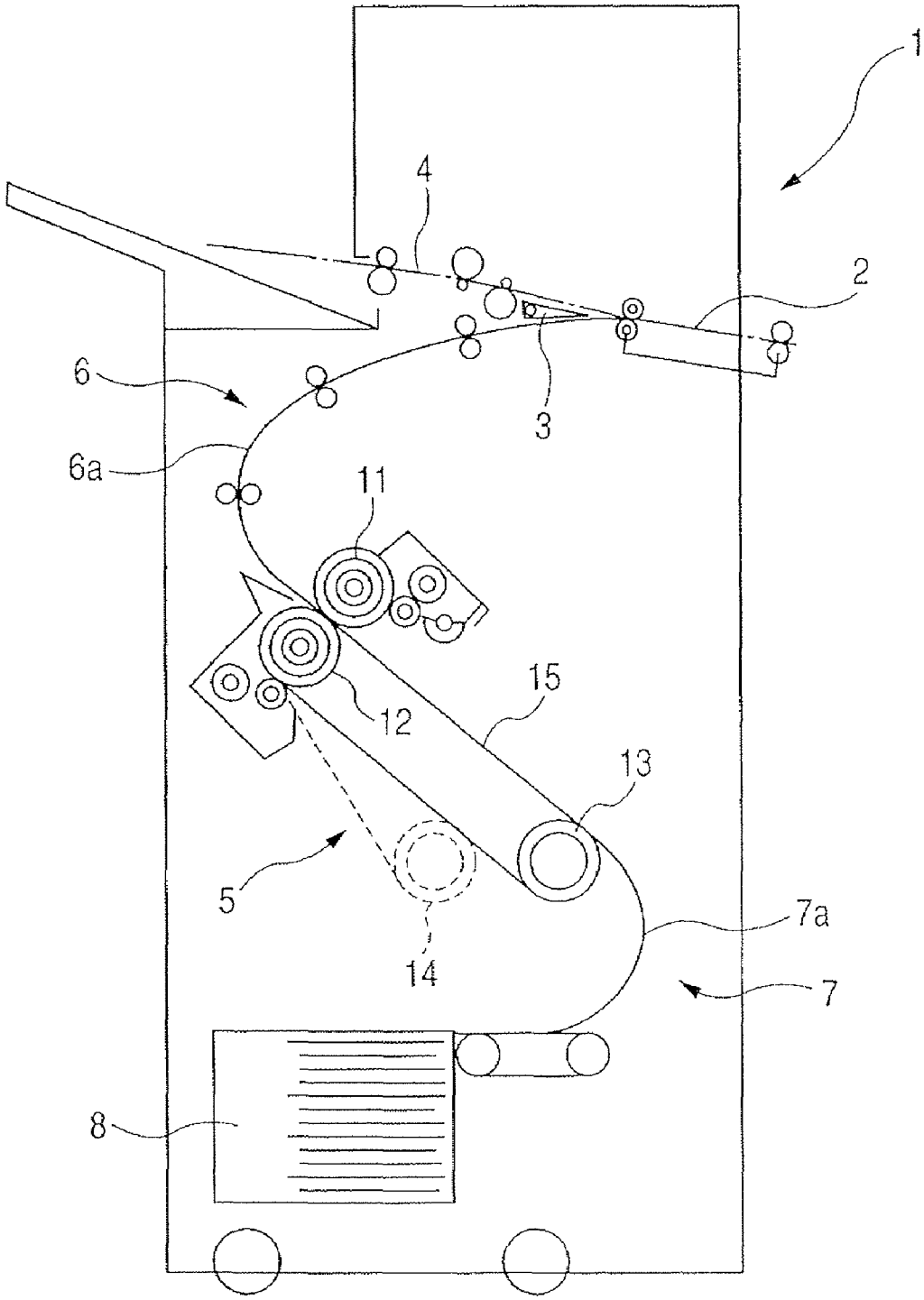
FIG. 2 is a view showing a schematic configuration of an external processing apparatus connected to an apparatus main body of the color copying machine.

FIG. 2 is a view showing a schematic configuration of the external processing apparatus 1 connected to the apparatus main body 200. The external processing apparatus 1 is capable of selectively performing high-glossiness processing or non-glossiness processing. The external processing apparatus 1 has a unit configuration provided detachably with respect to the apparatus main body 200.

In FIG. 2, an upper conveying path 2 is provided in an upper portion of the external processing apparatus 1, and receives and conveys the sheet S discharged from the apparatus main body 200. The second heating portion 5 is used when the high glossiness processing is selected. The second heating portion 5 pressurizes the sheet S, on which a toner image is fixed by the first heating portion 204, at a high temperature to re-fix the toner image, thereby smoothening the toner image to obtain high surface glossiness.

A discharge path 4 discharges the sheet S as it is, or sends the sheet S to a following finishing unit (not shown), in the case where the non-glossiness processing is selected. An ante-fixation conveying path 6 is a substantially U-shaped first conveying path for reversing the sheet S to the second heating portion 5 in the case where the high glossiness processing is selected, and has a curved guide surface 6*a*.

A branch flapper 3 switches the conveying path between the discharge path 4 and the ante-fixation conveying path 6 in accordance with the kind of selected processing, that is, the high glossiness processing or the non-glossiness processing. A post-fixation conveying path 7 is a second conveying path formed in a substantially U-shape, which inverts and conveys the sheet S after the fixation by the second heating portion 5. The post-fixation conveying path 7 has a guide surface 7*a* curved in an opposite direction to the guide surface 6*a* of the ante-fixation conveying path 6.

A stack tray 8 is provided on a downstream side of the second heating portion 5, and stacks the sheet S conveyed through the post-fixation conveying path 7 after an image of high glossiness is finally fixed thereon by the second heating portion 5.

Thus, the external processing apparatus 1 includes the ante-fixation conveying path 6 that inverts the sheet S guided by the upper conveying path 2 and conveys the sheet S to the second heating portion 5, and the post-fixation conveying path 7 that inverts and conveys the sheet S after the fixation by the second heating portion 5. Because of this, the sheet S is inverted by the ante-fixation conveying path 6 and conveyed to the second heating portion 5, and after the heating operation by the second heating portion 5, the sheet S is inverted by the post-fixation conveying path 7 to be conveyed to the stack tray 8.

That is, in the external processing apparatus 1, the guide surface 6*a* of the ante-fixation conveying path 6 and the guide surface 7*a* of the post-fixation conveying path 7 form an S-shaped path as a whole. Then, by arranging the ante-fixation conveying path 6, the second heating portion 5, and the post-fixation conveying path 7 successively from above to form the S-shaped conveying path, the width of the external processing apparatus 1 in a front view can be shortened. Consequently, the setting area of the apparatus can be suppressed, and the height thereof can be reduced.

In this embodiment, the second heating portion 5 is configured so as to perform fixation under the condition that the high-gloss image formation surface which is an image fixation surface of the sheet S is directed downward. The external processing apparatus 1 is configured so that the image fixation surface is directed upward in a case where the external processing apparatus 1 receives the sheet S from the apparatus main body 200, and the external processing apparatus 1 receives the sheet S inverted by the ante-fixation conveying path 6 under the condition that the high-gloss image formation surface is directed downward.

Owing to this configuration, a sheet conveying sequence on the apparatus main body 200 side can be prevented from being complicated, and various external connection units can be handled. Further, the apparatus main body 200 can give the sheet S to the external processing apparatus 1 under the condition that the surface with an image formed (fixed) thereon is directed upward, which makes it unnecessary to perform inverse discharging in the apparatus main body, and hence minimizes the damage to the image formation (fixation) surface of the sheet S.

On the other hand, the configuration of the second heating portion 5 in the external processing apparatus 1 adopts a method for conveying the sheet S in a contacting manner under the condition that the high-gloss image formation surface is directed downward. Therefore, it is necessary to invert the sheet S received in the fixing apparatus and convey the sheet S to the second heating portion 5. However, the external processing apparatus 1 does not have a so-called switch back inversion mechanism of stopping the conveyance once and then conveying the sheet S in an opposite direction, but has an inversion mechanism in which a conveying direction does not change. Therefore, an image surface is hardly damaged, and a satisfactory image of high quality can be obtained.

In the case of discharging the sheet S discharged from the apparatus main body 200 and allowing the sheet S to pass through the second heating portion 5 to discharge the sheet S to the stack tray 8 as in the external processing apparatus 1, it is desirable to curve the conveying paths 6 and 7 in directions different from each other, considering the setting area of the entire apparatus. Further, owing to such the arrangement configuration, the curl direction of the sheet S is not limited to one direction, which can prevent the occurrence of a curl, and enables preferable quality to be obtained.

However, generally, in the case of allowing the sheet S of immediately after fixation to pass through a curvature path, when the sheet S is conveyed with the image formation surface directed outward in a radius direction, the image fixation surface of the sheet S is likely to be rubbed by the guide surface, and minute conveyance scratches may remain on the image surface.

In the case of conveying the sheet S through the ante-fixation and post-fixation conveying paths 6 and 7 having the guide surfaces 6*a* and 7*a* curved in different directions from each other, the image formation surface may be directed outward in a radius direction without fail. In this case, minute conveyance scratches may remain on the image fixation surface of the sheet S as described above.

However, in this embodiment, the curvature path (guide surface 6*a*) in which the image fixation surface is directed outward is placed on an upstream side of the second heating portion 5, and the curvature path (guide surface 7*a*) in which the image fixation surface is directed inward is placed on a downstream side of the second heating portion 5. Because of this, the damage to the image formation (fixation) surface subjected to the processing by the second heating portion 5 can be minimized.

More specifically, as described above, the second heating portion 5 in this embodiment presses again the image surface subjected to the fixation by the first heating portion 204 provided in the apparatus main body 200 under pressure at high temperature, thereby forming a smooth surface. Therefore, even when minute scratches develop on the image formation (fixation) surface while the sheet S from the apparatus main body 200 passes through the guide surface 6*a* of the ante-fixation conveying path 6 under the condition that the image fixation surface is directed outward, the minute scratches can be eliminated during the formation of a smooth surface by the second heating portion 5. Then, when the sheet S passes through the guide surface 7*a* of the post-fixation conveying path 7, the image fixing surface is directed inward, so minute scratches will not develop.

Next, the operation of the external processing apparatus 1 thus configured will be described.

First, the case of outputting a sheet having an ordinary non-glossy (or low-glossy) image will be described. In this case, when the sheet S with a non-glossy (or low-glossy) image formed thereon in the apparatus main body 200 is sent to the external processing apparatus 1, the sheet S is sent to the discharge path 4 provided in an upper portion by the branch flapper 3, and discharged as it is. Alternatively, the sheet S is given to a finishing unit that is a following unit.

First, the case of outputting a sheet having a high-gloss image will be described. In this case, when the sheet S with an image of high glossiness formed thereon, formed in the apparatus main body 200, is sent to the external processing apparatus 1, the branch flapper 3 is switched, and the sheet S is conveyed to the ante-fixation conveying path 6. After that, the sheet S is subjected to the heating operation by the second heating portion 5, passes through the post-fixation conveying path 7, and then, is discharged to the stack tray 8.

While the sheet S passes through the ante-fixation conveying path 6, although some scratches develop on an image surface fixed by the first heating portion 204, the scratches are eliminated during the formation of a smooth surface by the second heating portion 5 as described above. Further, in the post-fixation conveying path 7, the sheet S is conveyed with the high-gloss image formation surface is directed inward, in other words, the opposite surface of the image fixation surface passes along the guide surface 7*a*. Therefore, an image is unlikely to be damaged. Thus, even when using the curved guide surfaces 6*a* and 7*a* in the ante-fixation and post-fixation conveying paths 6 and 7, it is possible to supply a high-gloss image of high quality.

Figure 3:
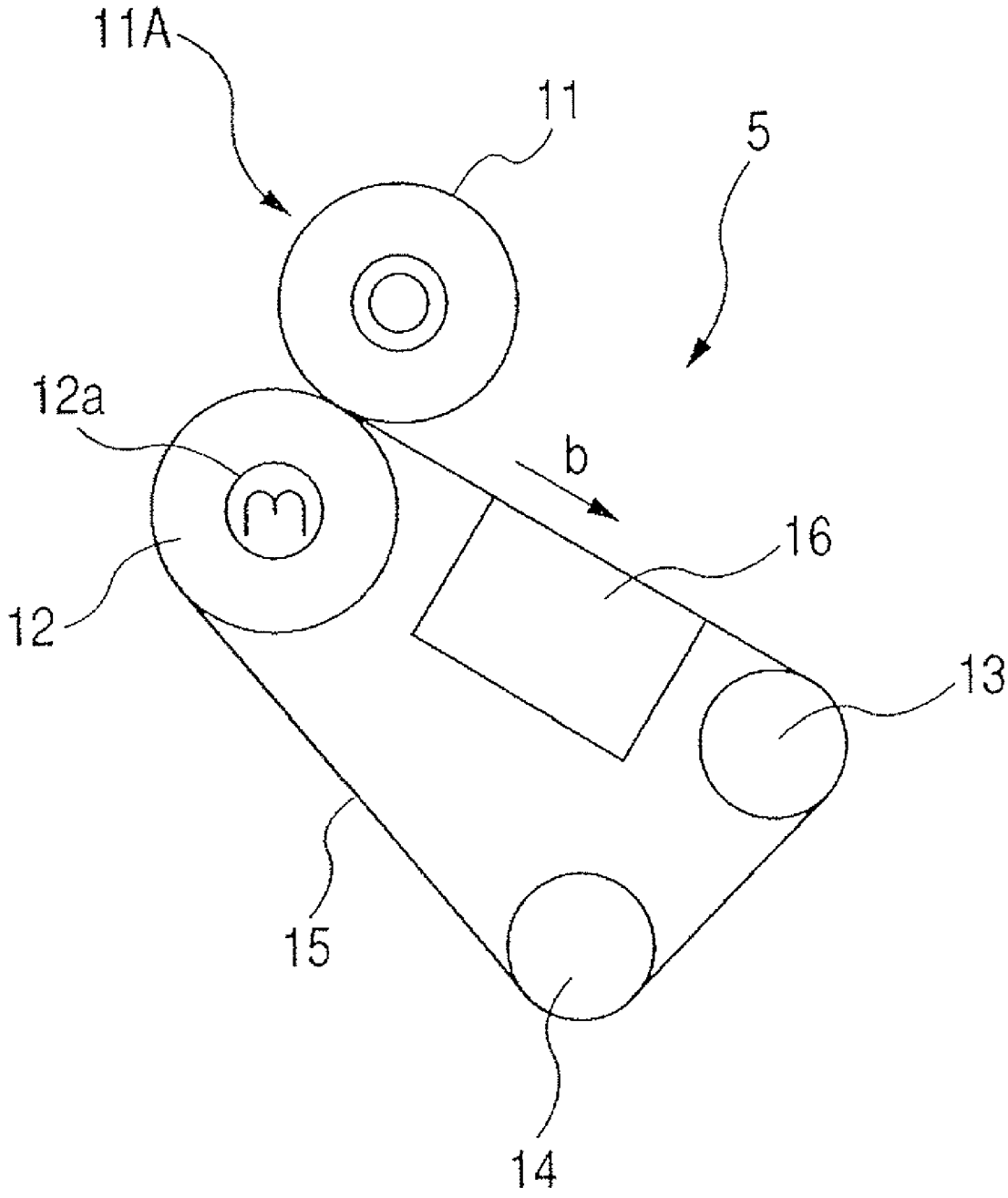
FIG. 3 is a view showing a configuration of a second heating portion of the external processing apparatus.

FIG. 3 is a view showing a configuration of the second heating portion 5 of the external processing apparatus 1. FIG. 3 shows a pressure roller 11, a heating roller 12, and an endless belt 15 conveyed while being sandwiched by the pressure roller 11 and the heating roller 12. The pressure roller 11 comes into contact with the heating roller 12 under pressure via the endless belt 15 to form a nip, thereby pressurizing and heating the sheet S on the endless belt. The pressure roller 11 is configured by coating a metallic cylindrical roll having high heat conductivity with an elastic layer (e.g., a silicone rubber layer with a JIS-A rubber hardness of about 40°) and a releasing layer (e.g., a tube made of fluororesin such as PFA).

Further, the heating roller 12 is obtained by coating a metallic cylindrical roll having high heat conductivity with a releasing layer (e.g., a tube made of fluororesin such as PFA), and placing a halogen heater 12*a* inside the roll. Herein, in this embodiment, the controlled temperature of the heating roller 12 is set to be 200° C., whereby a satisfactory fixing property is ensured even in the case of fixing toner images of four colors. The controlled temperature of the heating roller 12 is not limited thereto, and the number of developing apparatuses (the kind of toner) is not limited thereto.

Further, the endless belt 15 is formed by coating a belt substrate made of an endless film (75 μm or more) made of heat-curable polyimide, with a surface layer (30 μm or more) made of silicone rubber having a smooth surface, and is rotated in a direction represented by an arrow "b" in FIG. 3. During the fixation processing operation, the endless belt 15 is heated by the heating roller 12 together with the sheet S while an image fixation surface is pressed against the sheet S by the pressure roller 11, whereby a satisfactory fixing property can be ensured.

In FIG. 3, a separation roller 13 allows the sheet S to separate from the endless belt 15 due to its own stiffness. The outer dimension of the separation roller 13 is determined by an adhesion between the endless belt 15 and the sheet S and a winding angle of the endless belt 15 with respect to the separation roller 13.

A steering roller 14 prevents a belt end portion from being damaged by the deviated running occurring during a rotation of the endless belt 15. The steering roller 14 adjusts a traveling direction of the endless belt 15. Herein, the steering roller 14 displaces one end of an axis so that it tilts with respect to the axial line of the heating roller 12 by a displacement mechanism (not shown), whereby the traveling direction of the endless belt 15 is adjusted.

The endless belt 15 is wound around the heating roller 12 that is one of a pair of heating rollers 11A composed of the pressure roller 11 and the heating roller 12, the steering roller 14 that is a downstream side roller, and the separation roller 13.

A cooling apparatus 16 is cooling means that is placed between the heating roller 12 and the separation roller 13, and is in close contact with an inner peripheral surface that is opposite to a sheet pressing surface of the endless belt 15. The cooling apparatus 16 absorbs the heat of the sheet S via the endless belt 15. The cooling apparatus 16 is formed of a heat sink and the like. Further, a cooling target temperature of the cooling apparatus 16 is set so that a temperature of the sheet S on the endless belt 15 is generally in a range of 60° C. to 80° C., although varying depending upon the kind of toner to be used, an image receiving layer of a sheet, and the like.

The cooling apparatus 16 can decrease a thermal influence on a sheet with a high-gloss image fixed thereon by cooling, which is caused by the heat of the sheet passing through the ante-fixation conveying path 6 in the above. Further, the cooling means that is conventionally provided separately for controlling a temperature of the inside of the apparatus becomes unnecessary. As the cooling apparatus 16, the one having a configuration of cooling the sheet S with a cooling fan may be used.

Further, in this embodiment, as shown in FIG. 3, at least a stretched surface from the heating roller 12 to the cooling apparatus 16 in the endless belt 15 is placed so as to tilt downward from a horizontal surface. That is, by setting a sheet delivery and receipt portion of the second heating portion 5 with respect to the ante-fixation conveying path 6 at a position higher than a delivery and receipt portion with respect to the post-fixation conveying path 7, the endless belt 15 is tilted so that the cooling apparatus 16 is positioned below the pair of heating rollers 11A.

This can eliminate the unwanted heat movement to the cooling apparatus 16, and can prevent a decrease in ability of the cooling apparatus 16, which also contributes to a miniaturization of the entire apparatus. In this embodiment, by setting an angle of the belt stretched surface to be about 30°, satisfactory cooling ability can be obtained, and the temperature control of the heating roller 12 and the temperature control of the cooling apparatus 16 can be achieved.

Next, the operation of forming a high-gloss image by the second heating portion 5 will be described.

First, in this embodiment, as one procedure of obtaining a high-gloss image, the following method is adopted. In the case where a user desires to output a high-gloss image, a high-gloss image output sheet is preferably used.

Figure 4A:
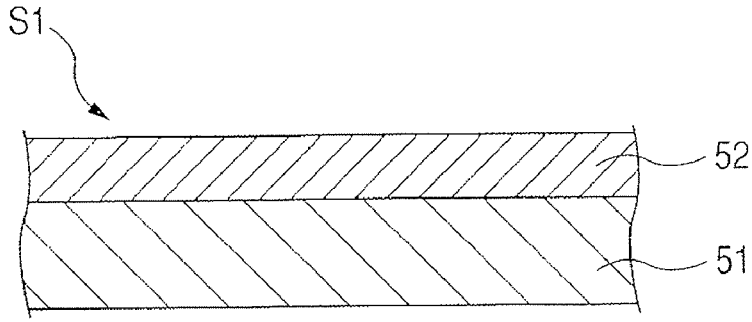
FIG. 4A shows a configuration of a high-gloss image output sheet used in the color copying machine.

As the high-gloss image output sheet, as shown in FIG. 4A, a glossiness output sheet S1 provided with a transparent image receiving layer 52 made of thermoplastic resin on one surface of a sheet-shaped substrate 51 is used. In the glossiness output sheet S1, the surface on which the image receiving layer 52 is formed has glossiness uniform over the entire surface.

Then, in a special output mode of outputting an image provided with high glossiness, the glossiness output sheet S1 is used. Even with coated paper or the like other than the glossiness output sheet S1, an image having glossiness to some degree can be output.

In contrast, in an ordinary output mode, if a non-glossy image is to be output, a sheet that hardly has glossiness, such as plain paper of a prescribed size such as A4 and B5 is used. Further, if a low-glossy image is to be output, a sheet that has a smooth surface and slight glossiness, such as coated paper is used.

Herein, in a special output mode, when the sheet S with a low-glossy and non-glossy image fixed thereon is sent to the external processing apparatus 1, the sheet S is heated and pressed while passing through a nip between the endless belt 15 heated by the heating roller 12 and the pressure roller 11. Further, the sheet S is conveyed in close contact with the endless belt 15 even after passing through the nip.

Next, the sheet S in contact with the endless belt 15 is cooled to a predetermined temperature (60° C. to 80° C.) by the cooling apparatus 16 and then separated from the endless belt 15 at a certain portion of the separation roller 13.

Figure 4B:
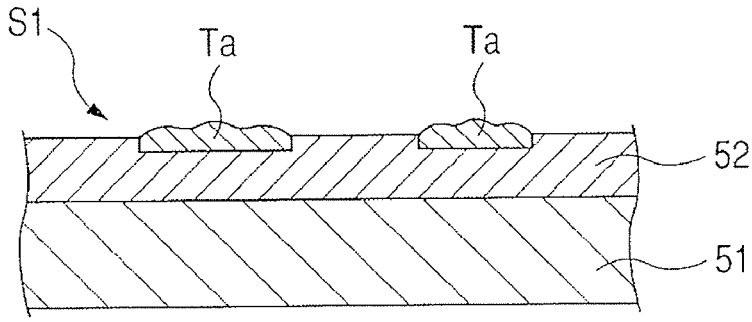
FIG. 4B shows a state of the high-gloss image output sheet after first heating.

A toner image on the sheet S subjected to fixing processing in the first heating portion 204 of the apparatus main body 200 is slightly buried in the surface of the image receiving layer 52, as shown in FIG. 4B.

In this embodiment, in the processing of the second heating portion 5, first, the image receiving layer 52 of the sheet Si is melted by heating in the second heating portion 5. Then, the image receiving layer 52 and a toner image Ta after first fixation, which is melted in the same way as in the image receiving layer 52 and buried therein, are cooled by the cooling apparatus 16. Further, after this, the entire surface of the image receiving layer 52 including the toner image Ta is solidified in a smooth surface state following the surface of the endless belt 15.

Figure 4C:
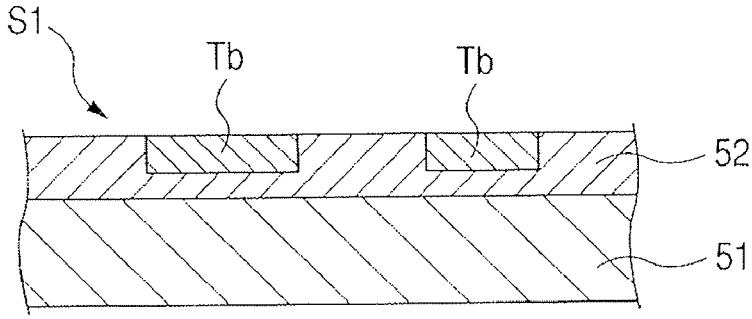
FIG. 4C shows a state of the high-gloss image output sheet after second heating.

By performing the processing of the second heating portion 5, the toner image Ta is substantially completely buried in the image receiving layer 52 along the smooth surface of the endless belt 15, as shown in FIG. 4C, whereby a toner image Tb with glossiness having a smooth surface is obtained. The sheet S subjected to the processing by the second heating portion 5 passes through the post-fixation conveying path 7 to be discharged onto the stack tray 8, as described above.

Figure 5A:
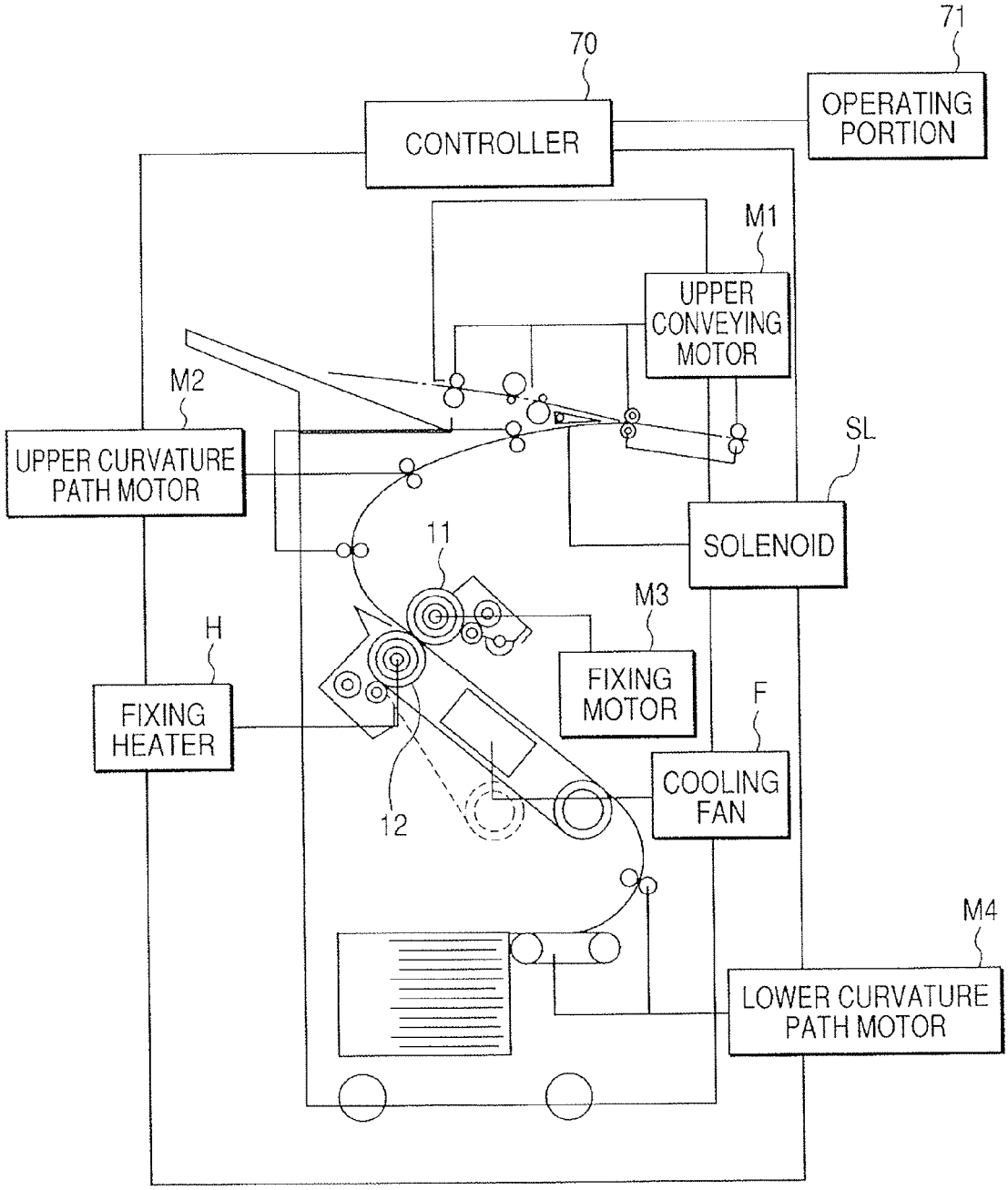
FIG. 5A shows arrangement configurations of a driving portion and a heating portion of the external processing apparatus.
Figure 5B:
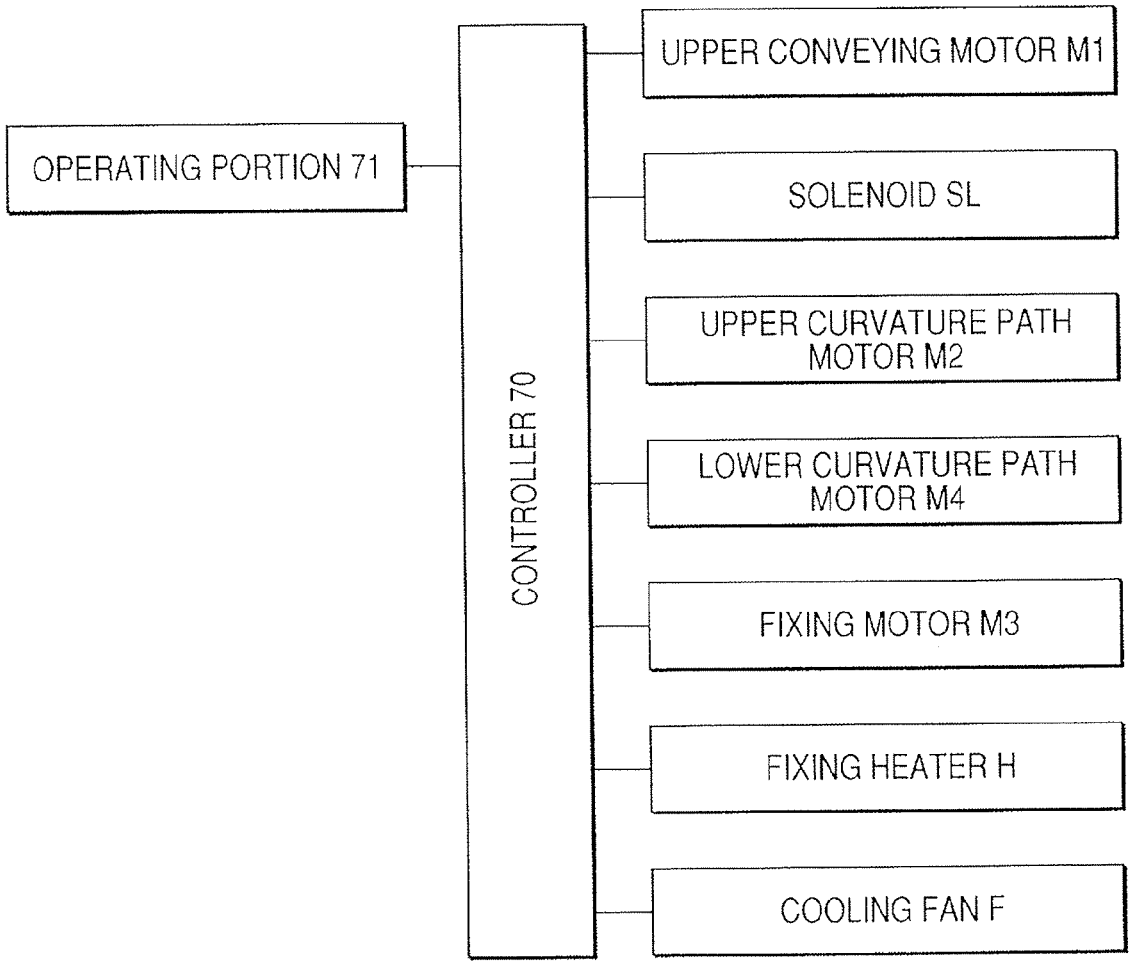
FIG. 5B is a control block diagram of the external processing apparatus.
Figure 6:
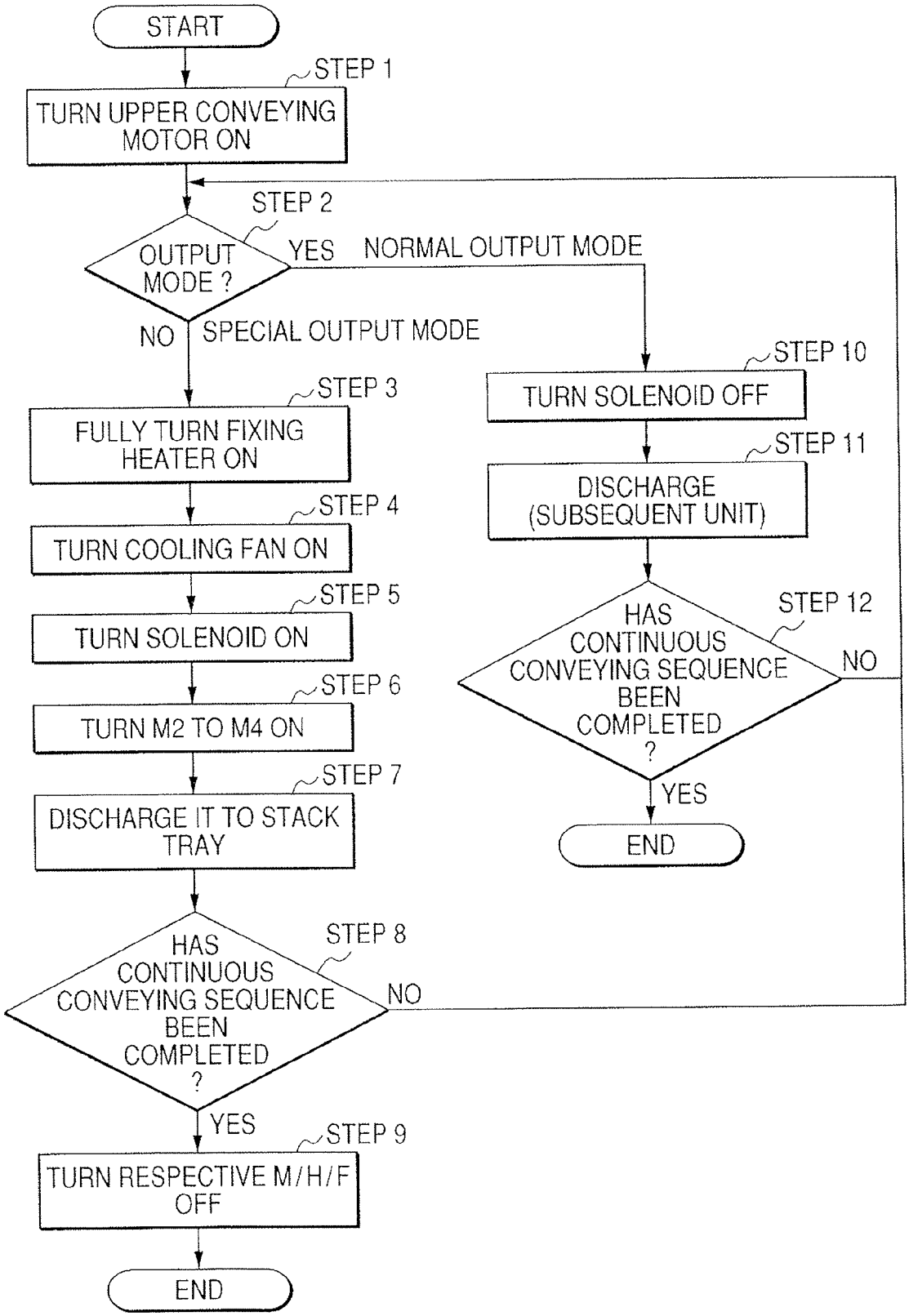
FIG. 6 is a flow chart illustrating fixing control of the external processing apparatus.

FIG. 5A is a view showing arrangement configurations of a driving portion and a heating portion of the external processing apparatus 1, and FIG. 5B is a control block diagram of the external processing apparatus 1. In FIGS. 5A and 5B, a controller 70 controls the operation of the external processing apparatus 1. The controller 70 is formed of a microcomputer composed of a CPU, a ROM, a RAM, and the like. The controller 70 executes a control operation in accordance with a control program stored in a memory such as the ROM, and contents of selection instruction information input from an operation portion 71 and other OA appliances. A control program regarding each operation described later is also stored in the memory such as the ROM.

Further, the controller 70 sends required control signals to an upper conveying motor (M1) for driving a conveying roller and the like provided in the discharge path 4, and a solenoid (SL) for driving the branch flapper 3. Further, the controller 70 sends required control signals to an upper curvature path motor (M2) for driving a conveying roller and the like provided in the ante-fixation conveying path 6, a fixing motor (M3) for driving the pressure roller 11, and a halogen heater 12*a* as a fixing heater (H) in the heating roller. Further, the controller 70 sends required control signals to a lower curvature path motor (M4) for driving a conveying roller and the like provided in the post-fixation conveying path 7, and a cooling fan (F) as the cooling apparatus 16.

The operation portion 71 is provided at a predetermined position of the external processing apparatus 1 or the apparatus main body 200. The operation portion 71 includes keys for inputting setting, selection, determination, and execution instructions of various conditions when the external processing apparatus 1 is used, a selection menu of the setting, operation state, and various conditions of the external processing apparatus 1, and a display portion for displaying input information, etc.

Herein, although the display portion may be a general liquid crystal display screen or a lamp, a touch-panel type liquid crystal display screen capable of performing selection instruction and input of information, as well as displaying information is usually used. The instruction information input in the operation portion 71 is sent to the controller 70, and a predetermined display is performed on the display portion, depending upon the control operation from the controller 70, the output situations from other OA appliances, or the like.

The external processing apparatus 1 can select either an ordinary output mode of outputting an image (copy, print) of general quality (low-glossiness and non-glossiness quality) in accordance with a predetermined selection instruction, and a special output mode (glossiness providing mode) of outputting an image with high glossiness. The selection instruction is performed directly by displaying a predetermined input screen or the like from the operation portion 71 with a touch-panel type liquid crystal display screen, or is performed together with the selection input operation and the like from the other OA appliances.

Further, in the apparatus main body 200, in order to reliably output an image of desired quality, the sheet S corresponding to each output mode can be used. For example, the glossiness output sheet S1 is accommodated in the sheet feed cassette 211 shown in FIG. 1, and the sheet S such as plain paper, coated paper, or the like is accommodated in the sheet feed cassette 210 shown in FIG. 1, and an appropriate sheet is automatically selected to be fed in accordance with each output mode.

Hereinafter, the main operation of the external processing apparatus 1 when each output mode is selected will be described.

In the case where the apparatus main body 200 requests the reception of a sheet, the controller 70 first turns on the upper conveying motor (M1) (step 1) and instructs the upper conveying motor (M1) to rotate. Thus, the external processing apparatus 1 is ready to receive the sheet S from the apparatus main body 200. Next, the controller 70 communicates information with the control device 62 on the side of the apparatus main body 200, and determines whether the output mode of the sheet S to be sent is a special output mode or an ordinary output mode (step 2).

Herein, in this embodiment, for example, in the case where the operation portion 71 sets the feed of the glossiness output sheet S1 accommodated in the sheet feed cassette 211, the controller 70 determines that the special output mode (glossiness providing mode) is selected. In this case, in order to transfer a toner image to an image receiving layer surface side, it is necessary to feed the glossiness output sheet S1 so that its image receiving layer 52 is positioned on a transfer surface side. Therefore, the sheet S1 is accommodated in the sheet feed cassette 211 under the condition that a surface of the sheet S1 on which the image receiving layer 52 is provided is directed downward.

Next, when the output mode is determined to be a special output mode (NO in step 2), a fixing heater H of the second heating portion 5, which is previously controlled to a lower temperature in a stand-by mode such as an energy-saving mode, is fully turned on (step 3). Further, in the case of using a cooling fan as the cooling apparatus, the cooling fan is turned on (step 4).

Next, owing to a series of image forming processes in the apparatus main body 200, when it is determined that a permanent toner image is formed on the sheet S1 determined to have high glossiness, and the sheet S1 has been sent to the external processing apparatus 1, the solenoid is turned on (step 5). Because of this, the branch flapper 3 in a branch portion is switched to a lower conveying side, and conveys the sheet S1 to the ante-fixation conveying path 6. During this time, the controller 70 turns on the upper curvature path motor (M2), the fixing motor (M3), the lower curvature path motor (M4), and the like at any time (step 6).

Consequently, the sheet S1 sent from the apparatus main body 200 is conveyed from the ante-fixation conveying path 6 to the second heating portion 5, and is subjected to heating operation with enhanced smoothness by the second heating portion 5. After this, the sheet S1 is discharged from the post-fixation conveying path 7 to the stack tray 8 (step 7).

At this time, as described above, a fixed toner image on an image surface side, which has been ordinarily fixed once, is pushed again onto the endless belt 15 side while being fused, whereby a smooth image of high glossiness can be fixed. Further, as described above, in the post-fixation conveying path 7, the sheet S is conveyed under the condition that a high-gloss image formation surface is directed inward. Therefore an image is unlikely to be damaged, and an image of high glossiness without any degradation in quality is formed on a sheet.

Next, it is determined whether or not a continuous conveying sequence has been completed (step 8). In the case where it is determined that the continuous conveying sequence has been completed (YES in step 8), respective M (motor)/H (heater)/F (fan) are turned off (step 9), and the control sequence is completed.

On the other hand, when the operation portion 71 sets the feed from the sheet feed cassette 210 containing the sheet S such as plain paper or coated paper, the controller 70 determines that the output mode is an ordinary output mode. Then, when it is determined that the output mode is the ordinary output mode (YES in step 2), the solenoid is turned off (or an OFF state is kept) (step 10). Through this process, the branch flapper 3 is switched to an upper conveying side, and conveys the sheet S2 to the discharge path 4.

Next, the sheet S conveyed to the discharge path 4 is delivered to a discharge tray or another finishing system (not shown) that is a connected subsequent unit (step 11). During this time, it is determined whether or not the continuous conveying sequence has been completed (step 12). In the case where it is determined that the continuous conveying sequence has been completed (YES in step 12), the control sequence is completed. Through this process, a non-glossy or low-glossy image is formed on the sheet S.

As described above, when the sheet S subjected to the heating operation by the second heating portion 5 is conveyed through the post-fixation conveying path 7, the sheet S is conveyed so that the image fixation surface and the opposite surface pass along the guide surface 7*a*, whereby a high-gloss image can be formed. Further, as described above, an S-shaped path is formed, and the ante-fixation conveying path 6, the second heating portion 5, and the post-fixation conveying path 7 are placed in a vertical direction, whereby the width of the external processing apparatus 1 can be shortened, and the height thereof can be decreased.

Consequently, the setting area can be reduced while the increase in quality of a high-gloss image is achieved at a higher level, and a high-quality image of high glossiness can be supplied to users widely without limiting a user to use the apparatus. This can enlarge an introduction destination in which the system of the present invention can be introduced.

Further, even in the case where a sheet of a large size is handled, a sheet with image information attached thereto is allowed to pass through the second heating portion 5, and a cutting portion for cutting a sheet with a final image fixed thereon into a desired size, the apparatus can be arranged easily without being enlarged.

Further, to meet the demand for a setting place and an equipment introduction cost at a copy shop or the like which actually has a demand for printing on a reverse surface of a silver halide photography of high glossiness, the present invention can provide an image forming apparatus of an ordinary price, which can be set in a compact size, obtain an image of high quality in a silver halide photography tone, and simultaneously print on a reverse surface.

According to this embodiment, a sheet with a toner image fixed thereon by the first heating portion is subjected to the heating operation by the second heating portion, and the sheet is conveyed to the second conveying path having a curved guide surface. Accordingly, the second heating portion and the second conveying path can be set in a height direction, and the setting area of the apparatus can be suppressed even in the case where the second heating portion is provided. Further, a sheet is conveyed so that the surface opposite to the image fixation surface is allowed to pass along a guide surface, so an image of high glossiness can be obtained without scratching the image surface of the sheet with the guide surface.

Hitherto, the configuration in which the second heating portion 5 is placed in the external processing apparatus 1 connectable to the apparatus main body 200 has been described. However, the present invention is not limited thereto. For example, the second heating portion 5 may be placed on a downstream side of the first heating portion 204 in the apparatus main body 200 of the color copying machine (i.e., image forming apparatus) 200A. Even in this case, if the sheet S is conveyed to the second heating portion 5 through the ante-fixation conveying path 6, and the sheet S after the fixation by the second heating portion 5 is conveyed through the post-fixation conveying path 7, an S-shaped path is formed as a whole in the apparatus main body 200. This configuration can prevent the enlargement of the apparatus main body 200.

Further, in the configuration described above, the controller 70 is provided in the external processing apparatus 1, and the controller 70 controls the external processing apparatus 1. However, the control device 62 on the apparatus main body side may control the external processing apparatus 1.

Further, in the case of using a sheet with an image formed thereon by cutting it, a cutter mechanism may be placed between the second heating portion 5 and the stack tray 8. Further, the cutter mechanism may be placed at a position of the stack tray 8, and the stack tray 8 may be connected to the outside of the external processing apparatus 1.

Next, Embodiment 2 of the present invention will be described with reference to the accompanying drawings.

Figure 7:
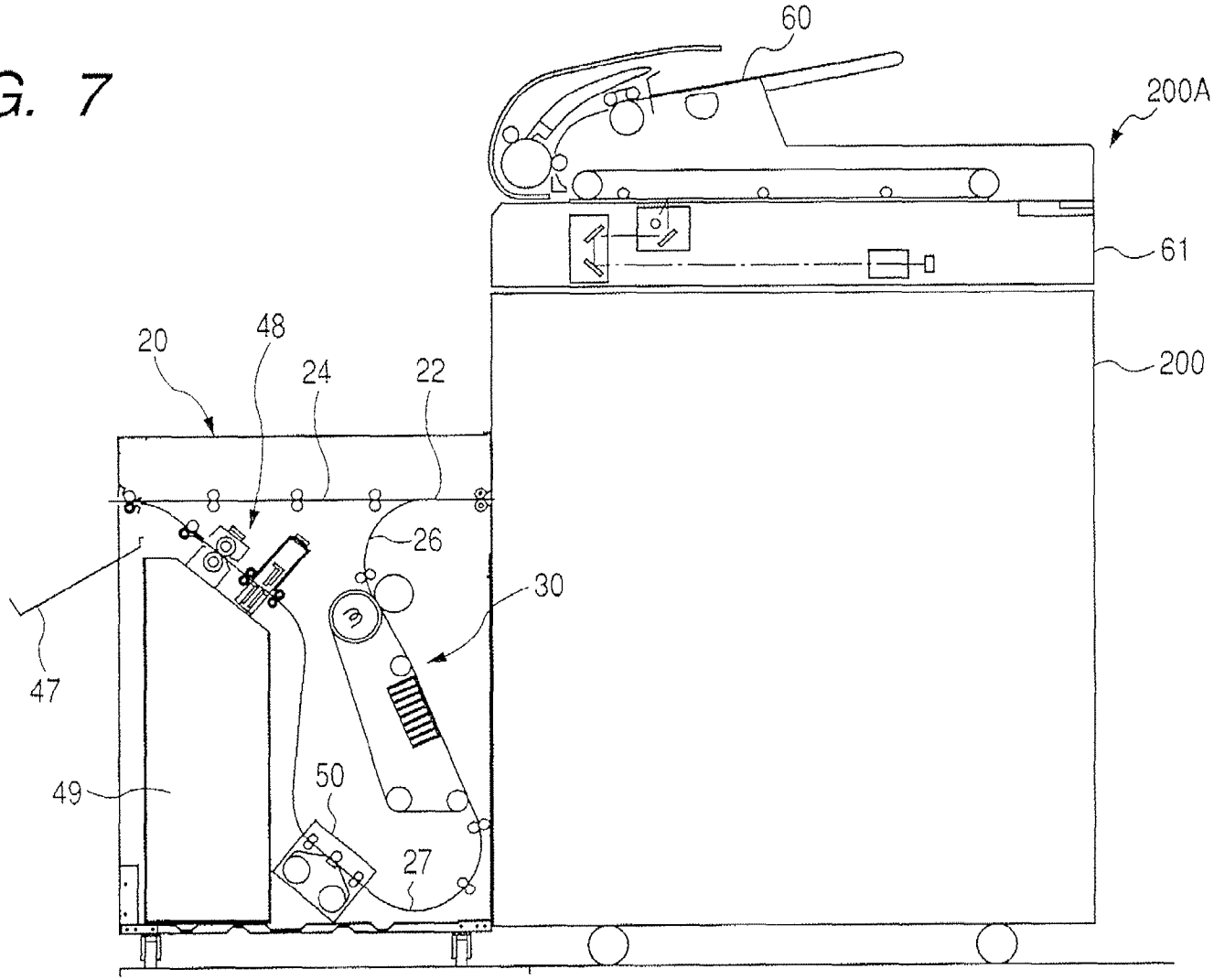
FIG. 7 shows a state in which an external processing apparatus of a second embodiment according to the present invention is connected to the color copying machine.
Figure 8:
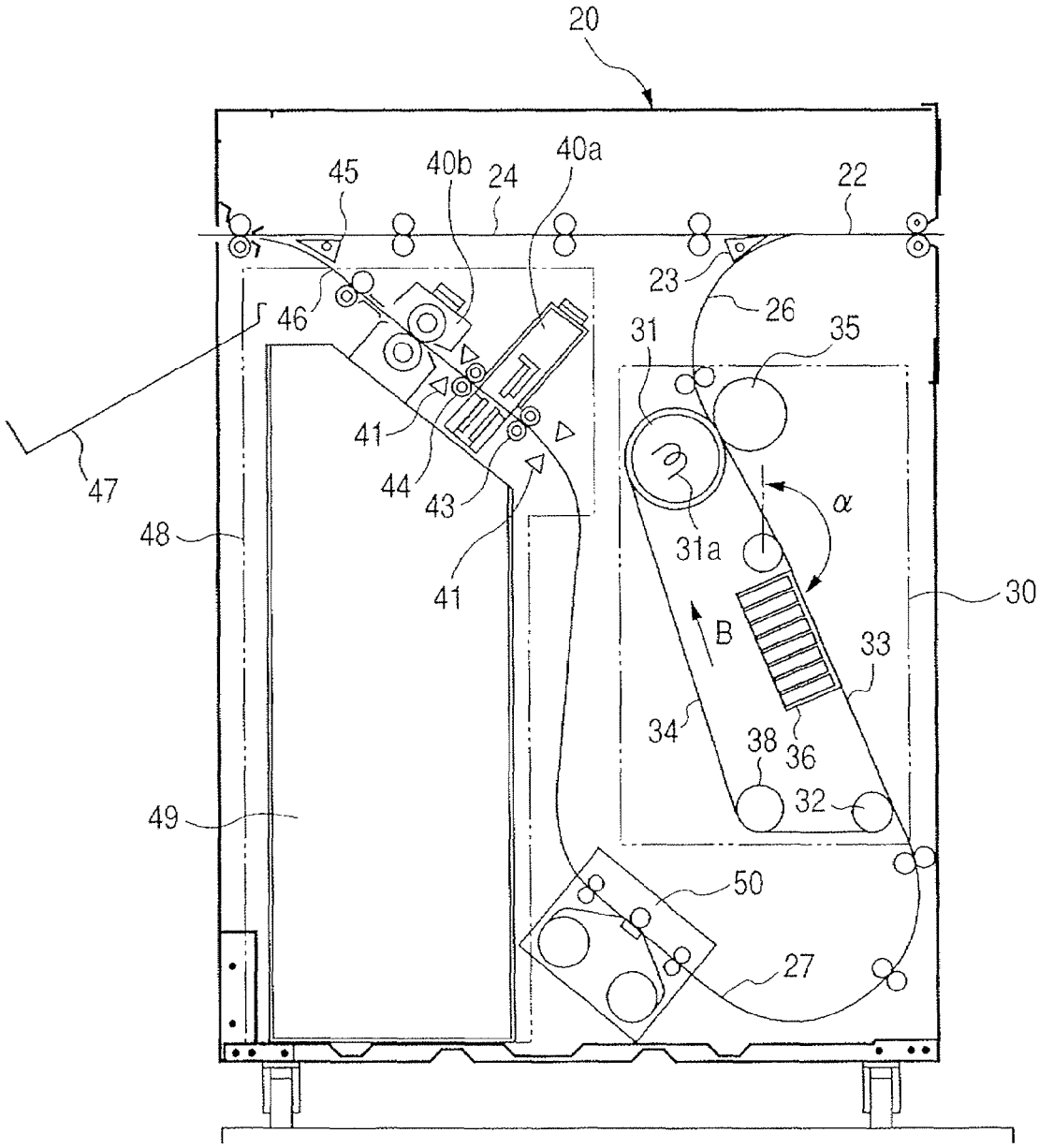
FIG. 8 is a cross-sectional view of the external processing apparatus.
Figure 9:
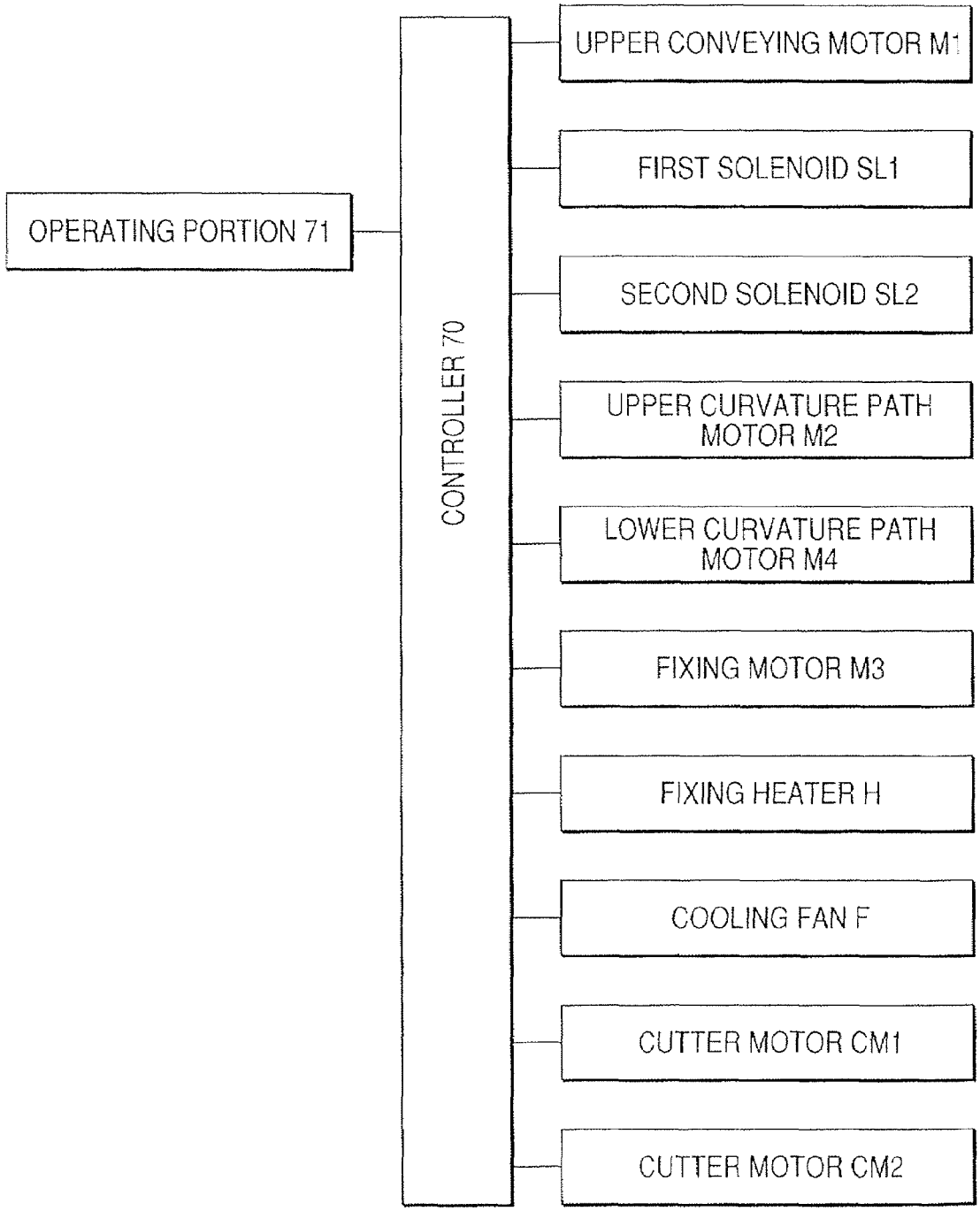
FIG. 9 is a control block diagram of the second embodiment.

FIG. 7 shows a state in which the external processing apparatus 20 of the second embodiment according to the present invention is connected to the color copying machine 200A. It should be noted that the apparatus main body 200, the image reading apparatus 60, and the image reading portion 61 are the same as those in the first embodiment, so the description thereof will be omitted. FIG. 8 is a view showing a main cross-section of the external processing apparatus 20. FIG. 9 is a control block diagram.

The external processing apparatus 20 is connected to the apparatus main body 200 of the image forming apparatus. In the upper portion of the external processing apparatus 20, an upper conveying path 22 for receiving and conveying a sheet S from the apparatus main body 200, and a first discharge path 24 for discharging the sheet S without performing any other process in the case where non-glossiness processing is selected are provided. The upper conveying path 22 and the first discharge path 24 are placed horizontally so that the sheet is conveyed without passing through a second heating portion 30 described later.

Further, an ante-fixation conveying path 26 is branched between the upper conveying path 22 and the first discharge path 24, and a first flapper 23 for switching the path is placed in the branch portion. The first flapper 23 is driven by a first solenoid SL1 shown in FIG. 9.

The ante-fixation conveying path 26 is provided so as to convey the sheet S to the second heating portion 30 in the case where high-glossiness processing is selected, and is formed substantially in a U-shape. The second heating portion 30 is placed so that a tilt a of a belt stretched surface 33 is substantially at 160° in a clockwise direction.

The second heating portion 30 includes a fixing belt 34 wound around a heating roller 31, a separation roller 32, and a stretching roller 38 that are driven to rotate by a driving source (not shown), and circulates in a direction indicated by the arrow B, a pressure roller 35 that presses the heating roller 31 by sandwiching the fixing belt 34, and is driven to rotate by a driving source (not shown), and a cooling apparatus 36 provided with a cooling fan F for cooling the fixing belt 34 on a downstream side of the heating roller 31. The surface of the fixing belt 34 is made of a material of high glossiness with high smoothness. A halogen heater 31*a* for heating is contained in the heating roller 31.

A post-fixation conveying path 27 substantially in a U-shape for inverting and conveying the sheet S after fixation, and a cutter unit 40 as a cutter mechanism for cutting the sheet S into a predetermined size are provided. The post-fixation conveying path 27 has a guide surface curved in a direction opposite to a guide surface of the ante-fixation conveying path 26.

The cutter unit 40 is composed of a vertical cutter 40*a* for cutting the sheet S into a predetermined length and a rotary cutter 40*b* for cutting the sheet S into a predetermined width, and a wastage box 49 for accommodating cutting wastages obtained by cutting the sheet S is provided immediately below the cutter unit 40. The vertical cutter 40*a* is driven by a cutter motor CM1 shown in FIG. 9, and the rotary cutter 40*b* is driven by a cutter motor CM2.

In the cutter unit 40, a tip end detecting sensor 41 and a registration roller 43 are placed on an upstream side of the vertical cutter 40*a*, and the tip end detecting sensor 42 and the conveying roller 44 are placed between the vertical cutter 40*a* and the rotary cutter 40*b*.

On a downstream side of the cutter unit 40, a second discharge path 46 for conveying the cut sheet S to a discharge portion, and a second flapper 45 for switching the conveying path to the discharge portion are provided. In the discharge portion, a discharge tray 47 for stacking the sheet S conveyed after fixation is placed. The second flapper 45 is driven by a second solenoid SL2.

Further, the post-fixation conveying path 27 between the second heating portion 30 and the cutter unit 40 is provided with a printing apparatus 50 of a printing system such as an ink jet system or a heat transfer system, for printing information such as a date and a serial number on a reverse surface of the sheet S.

FIG. 9 is a control block diagram of the external processing apparatus 20. In this figure, reference numeral 70 denotes a controller for controlling the operation of the external processing apparatus 1, and the controller 70 is formed of a microcomputer composed of a CPU, a ROM, a RAM, and the like. The controller 70 executes a control operation in accordance with the control program stored in a memory such as a ROM, and the contents of selection instruction information input from an operation portion 71 and other OA appliances. A control program regarding each operation described later is also stored in the memory such as a ROM.

Further, the controller 70 sends required control signals to an upper conveying motor (M1) for driving a conveying roller and the like provided in the discharge path 24, a first solenoid (SL1) for driving the first flapper 23, and a second solenoid (SL2) for driving the second flapper 45. Further, the controller 70 sends required control signals to an upper curvature path motor (M2) for driving a conveying roller and the like provided in the ante-fixation conveying path 26, a fixing motor (M3) for driving the pressure roller 35, and a halogen heater 31*a* as a fixing heater (H) in the heating roller 31. Further, the controller 70 sends required control signals to a lower curvature path motor (M4) for driving a conveying roller and the like provided in the post-fixation conveying path 37, and a cooling fan (F) as the cooling apparatus 36.

Next, the operation of this embodiment will be described.

First, the operation function in the case of outputting an ordinary image in the external processing apparatus 20 of this embodiment will be described. When the sheet S on which an image formed in the apparatus main body 200 is placed is sent to the external processing apparatus 20, the sheet S is sent to the first discharge path 24 provided above by the first flapper 23 to be discharged (or the sheet S is sent to the following finishing unit).

The operation in the case of outputting a glossy image will be described. The sheet S on which an image formed by the apparatus main body 200 is placed passes through the upper conveying path 22 to be branched by the first flapper 23, and is conveyed to the second heating portion 30 through the ante-fixation conveying path 26 provided in the lower portion. At this time, the sheet S is conveyed with the image surface side fixed by the first heating portion 204 guided along the guide surface of the ante-fixation conveying path 26.

The sheet S conveyed to the second heating portion 5 is sandwiched between the pressure roller 15 and the heating roller 11 with a toner image directed to the fixing belt 14 surface, and the sheet S is pressed with the toner image being heated and fused.

Then, the sheet S is conveyed while being in contact with the fixing belt 14, and the toner image is solidified by cooling in the cooling apparatus 16. The sheet S is separated from the fixing belt 14 using the stiffness of the sheet S due to the curvature of the separation roller 12.

Thus, the sheet S is brought into contact with the belt surface, whereby the smoothness of a toner image surface can be kept. Further, the sheet S heated for a predetermined period of time is separated by the separation roller 32 under the condition that the toner image is solidified by cooling in the cooling apparatus 36 from the reverse surface side of the fixing belt 34, so the sheet S can be separated while keeping high glossiness. Further, at this time, the sheet S is conveyed with the surface opposite to the image surface side fixed by the second heating portion 30 being guided along the guide surface of the post-fixation conveying path 27.

After the fixation, the sheet S is conveyed to the printing apparatus 50 through the post-fixation conveying path 27, and the printing apparatus 50 prints information such as a date and a serial number on the reverse surface of the sheet S.

Then, the sheet S is conveyed to the cutter unit 40. When the tip end detecting sensor 41 detects the sheet S, the sheet S is conveyed by a predetermined distance so that the registration roller 43 forms a loop to stop the conveyance of the sheet S. The sheet S is conveyed again while keeping the arrangement. When the tip end detecting sensor 42 detects the tip end of the sheet S, the sheet S is conveyed by a predetermined distance in accordance with the size of the sheet S to be cut.

When the sheet S is conveyed, the sheet S is cut at a predetermined position by the vertical cutter 48*a*. Further, the sheet S is conveyed by a predetermined distance in accordance with the size of the sheet S to be cut, and the sheet S is repeatedly cut at a predetermined position, whereby the sheet S is cut into a predetermined length.

When the operation in the vertical cutter 48*a* is completed, the sheet S is conveyed. The sheet S is cut in the sheet conveying direction by the rotary cutter 48*b* placed in accordance with the width of the sheet S to be cut, whereby the sheet S is cut into a predetermined width.

The cut sheet S passes through the second discharge path 46, and is conveyed to the first discharge path 24 by the second flapper 45 that switches the conveying path. Then, the sheet S is discharged by the delivery roller, and placed on the discharge tray 47.

Herein, the accommodation amount of cutting wastages of the wastage box 49 will be described. The data obtained by an experiment is shown below, which represents how many sheets can be accommodated by the wastage box 49 with the following size. The data represents the maximum number of sheets of which cutting wastages will not adversely influence the vertical cutter 48*a* in the case where the sheets are cut into four with the respective sizes and allowed to fall naturally in the wastage box 49.

Size of a wastage box: width 220 mm, depth 410 mm, and height 250 mm

Size of a sheet: 320 mm×210 mm, thickness 0.2 mm

Size after cutting: L-size, 127 mm×89 mm

Size after cutting: 4×6, 152 mm×102 mm

| | Number of sheets until they reach the vertical cutter |
|---|---|
| L-size | 1100 |
| 4 × 6 | 2000 |

The following experimental results are obtained. The wastage box 49 of the present invention can be extended in a height direction by curving the post-fixation path upward, so the maximum number of sheets in natural fall is as follows.

| | Number of sheets until the wastage box is filled |
|---|---|
| L-size | 2000 |
| 4 × 6 | 3500 |

In this embodiment, the tilt a of the belt stretched surface 33 of the second heating portion 20 is placed substantially at 160° in a clockwise direction, whereby the size of the fixing apparatus main body in the width direction can be decreased.

Figure 10:
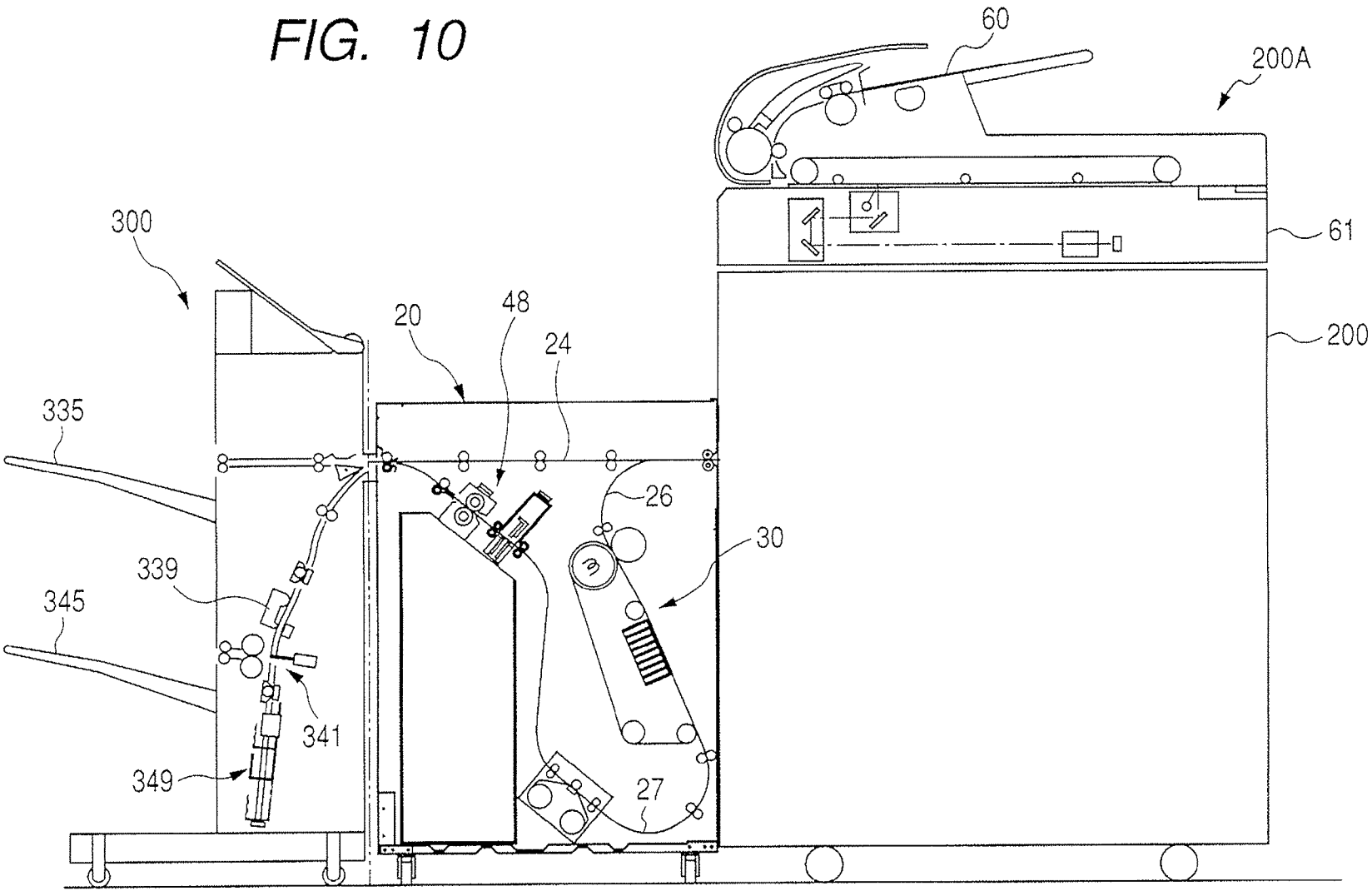
FIG. 10 shows an entire system in which the external processing apparatus and a finishing unit are mounted on the color copying machine.
Figure 11:
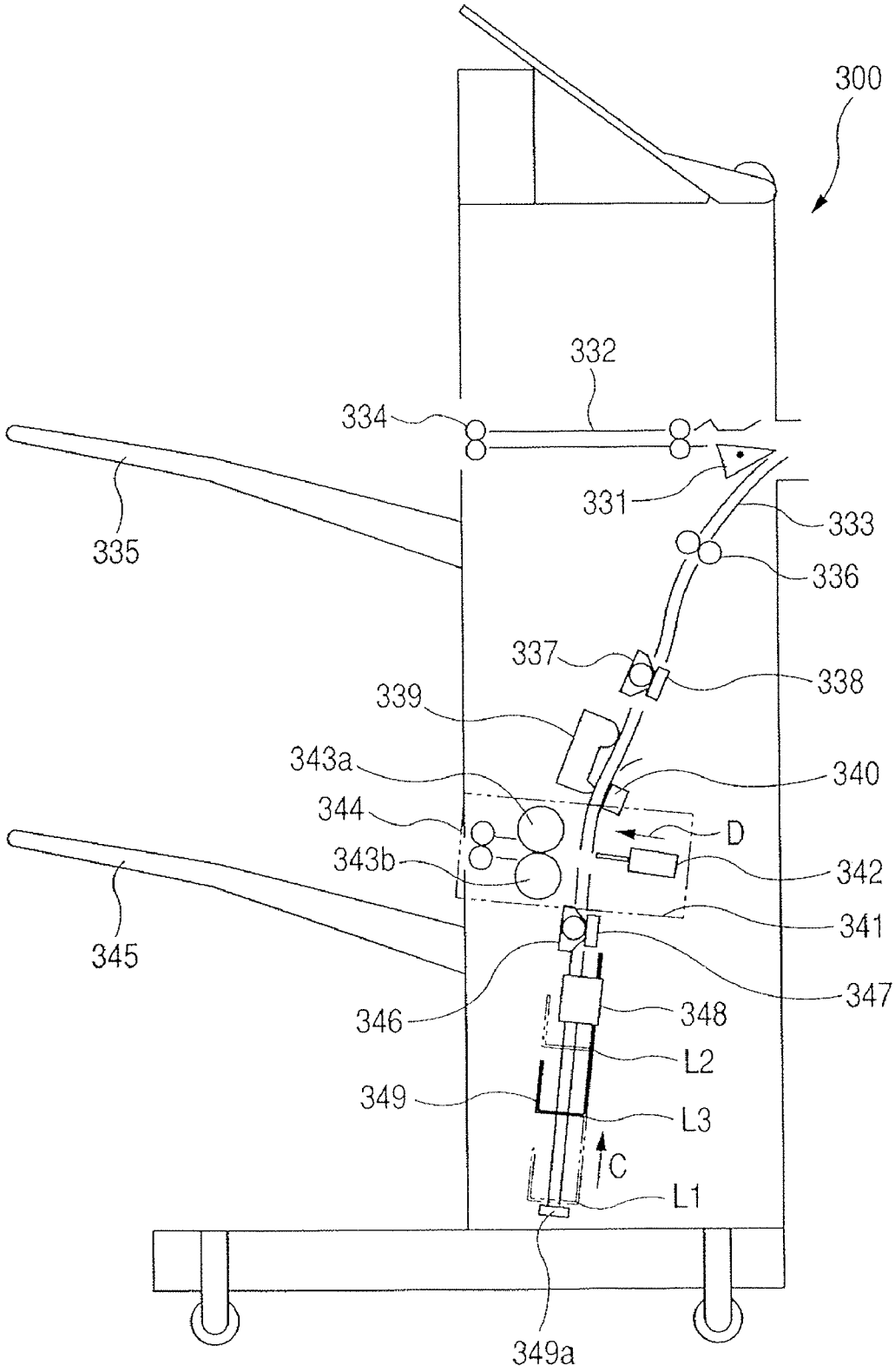
FIG. 11 is a cross-sectional view of the finishing unit.

Next, the case where the finishing unit 300 is mounted on the external processing apparatus 20 of the present invention will be described with reference to FIGS. 10 and 11. FIG. 10 is a view showing an entire system in which the external processing apparatus 20 and the finishing unit 300 are mounted on the color copying machine 200A. FIG. 11 is a cross-sectional view showing the finishing unit 300 alone.

For example, in the case of forming a number of glossy transfer sheets into one album, several images are laid out on one sheet S by the apparatus main body 200 as described above. The sheet S discharged from the color copying machine 200A is subjected to the processing by the external processing apparatus 20 to form a glossy image as described above. The sheet S is conveyed intact to the finishing unit 300 without being cut.

The transfer sheet S conveyed into the finishing unit 300 is sent to a sheet position determination unit 349 in the apparatus. Similarly, images are formed on the second and third sheets S successively, and kept in the sheet position determination unit 349. When the specified number is reached, saddle stitching is performed by a stapler unit 339, and the stacked transfer sheets S are folded by a folding unit 341 to be discharged out of the apparatus, whereby an album is completed.

The configuration of the finishing unit 330 will be described in detail with reference to FIG. 11.

In FIG. 11, reference numeral 331 denotes an inlet flapper, which switches a discharge path 332 and a bookbinding conveying path 333.

Reference numeral 334 denotes a delivery roller placed in the discharge path 332, which discharges the sheets S not subjected to bookbinding on an upper tray 335. Reference numeral 336 denotes a conveying roller, and 337 and 346 denote semilunar rollers. Elastic members 338 and 347 are placed on an opposed surface side.

Reference numeral 339 denotes a stapler unit, which contains a staple needle and driving means (not shown). An anvil 340 is placed on an opposite surface side of the stapler unit 339, which crushes both ends of the staple needle.

Reference numeral 341 denotes a folding unit in which an thrusting portion 342 to be thrust on the bundle of the sheets S and folding rollers 343*a* and 343*b* for folding the bundle of the sheets S are provided. Reference numeral 344 denotes a delivery roller, which discharges the bundle of the folded sheets S onto a lower tray 345.

Reference numeral 348 denotes a sheet jogger unit for adjusting the front and back directions seen from the drawing surface of the figure. A sheet jogger member (not shown) is provided in the sheet jogger unit 348, which pushes the sheets S from both sides to align them.

Reference numeral 349 denotes a sheet position determination unit for receiving the conveyed sheets S in a stopper portion 349*a*, and keeping them for bundling the sheets S.

Next, the operation of the finishing unit 300 will be described.

The sheet S conveyed from the color copying machine 200A to the external processing apparatus 20 is subjected to the processing in the external processing apparatus 20 to obtain a glossy image, and conveyed to the finishing unit 300. In the case where a bookbinding mode is not selected by an operator, the sheet S is guided to the discharge path 332 by the inlet flapper 331, and discharged onto the upper tray 335 by the delivery roller 334.

In the case where a bookbinding mode is selected, the sheet S is guided to the bookbinding conveying path 333 by the inlet flapper 331, and is conveyed to a position L1 of the stopper portion 349*a* of the sheet position determination unit 349 by the conveying roller 336 and the semilunar roller 337.

The conveyed sheet S is aligned to a predetermined position by the sheet jogger member in the sheet jogger unit 348.

Similarly, images are formed on the second and third sheets S successively, and the specified number of the sheets S is kept to be aligned in the sheet position determination unit 349.

When the specified number is reached, the sheet position determination unit 349 is moved by driving means (not shown) in a direction indicated by the arrow C to a position L2 that corresponds to a half of the sheet S on a downstream side from a staple point P of the stapler 339, and a staple operation (stapling at two positions) is performed, whereby a plurality of sheets S are bundled.

When the staple operation is completed, the sheet position determination unit 349 is moved by driving means (not shown) to a predetermined position L3 of the folding unit 341 on a downstream side, so as to fold a bundle of the sheets S.

Then, the thrusting portion 342 in the folding unit 341 is slid in a direction indicated by the arrow D to be thrust into between the folding rollers 343*a*, 343*b*. The thrust bundle of the sheets S are conveyed to the delivery roller 344 while being folded, and discharged onto the lower tray 345 by the delivery roller 344, whereby an album bookbinding is completed.

Thus, the sheet S is returned again to the discharge path 24 provided in the upper portion after being cut, whereby the finishing unit 300 that is an optional apparatus can be directly mounted on the fixing apparatus main body. Therefore, an album bookbinding or the like can be formed using the finishing unit 300, and consequently, a user can select a wide range of outputs.

As in this embodiment, among the sheets S with an image formed thereon in the color copying machine 200A, regarding the sheets S in which a high-gloss image is selected, the U-shaped ante-fixation conveying path 26 and the post-fixation conveying path 27 are curved in directions different from each other, considering the setting area of the entire apparatus. Owing to the arrangement configuration, the curl direction is not limited to one direction, and an optimum configuration can be obtained as the quality of a final product.

Further, by forming the ante-fixation conveying path 26, the second heating portion 30, and the post-fixation conveying path 27 successively from above to form an S-shaped conveying path, the width of the external processing apparatus 20 seen in a front surface can be decreased. Accordingly, the setting area of the apparatus can be suppressed, and the height thereof can be decreased.

Further, the second heating portion 30 performs high-temperature compression again, with respect to the image surface subjected to the fixation by the first heating portion 204 provided in the apparatus main body 200, thereby forming a smooth surface. Therefore, some scratches formed when the sheet S is guided along the guide surface of the ante-fixation conveying path 26 before being introduced to the second heating portion 30 are eliminated during the formation of a smooth surface. Further, on the guide surface of the post-fixation conveying path 27 on a downstream side of the second heating portion 30, the sheet S is conveyed with the high-gloss image formation surface placed inside, so an image is unlikely to be damaged. Thus, a high-gloss image of high quality can be supplied by using the conveying paths 26, 27 before and after the fixation. Thus, the setting area can be reduced in the entire image forming apparatus system while the increase in quality of a high-gloss image is achieved at a high level, whereby a high-quality image of high glossiness can be supplied to a wide range of users without limiting the user for using the apparatus.

In this embodiment, the setting area as the image forming apparatus system capable of obtaining a high-gloss image can be suppressed, so the introduction destination in which the system can be introduced can be enlarged.

Further, in this embodiment, the second heating portion 30 is placed in the external processing apparatus 20 connectable to the color copying machine 200A. However, the present invention is not limited thereto, and the second heating portion 30 may be placed in the image forming apparatus main body. Even in this case, the sheet S is conveyed with an S-shaped path curved as a whole in the image forming apparatus main body, so the enlargement of the entire image forming apparatus can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-223277, filed Aug. 1, 2005, and Japanese Patent Application No. 2006-199757, filed Jul. 21, 2006, which are hereby incorporated by reference herein in their entirety.

What is claimed is:

1. A glossiness processing apparatus, comprising:

a first heating portion configured to heat a sheet with a toner image transferred on the sheet;

a second heating portion configured to heat the sheet which is heated in the first heating portion;

a first conveying path configured to guide the sheet which is heated in the first heating portion to the second heating portion; and a second conveying path configured to guide the sheet from the second heating portion downstream, wherein the first conveying path, the second heating portion, and the second conveying path are arranged from above downward in order of mention, the second conveying path has a curved guide surface and the second conveying path ends at a position below the second heating portion, and when the sheet which is heated in the second heating portion is guided by the second conveying path, the sheet is guided so that a surface opposite to a surface on which the toner image is transferred moves along the curved guide surface.

2. A glossiness processing apparatus according to claim 1, wherein the first conveying path has a guide surface curved in a direction opposite to a curvature of the guide surface of the second conveying path.

3. A glossiness processing apparatus according to claim 2, wherein the first conveying path, the second heating portion, and the second conveying path form a sheet conveying S-shaped path.

4. A glossiness processing apparatus according to claim 1, further comprising a discharge path that is branched upstream of the first conveying path, and conveys the sheet fixed in the first heating portion without allowing the sheet to pass through the second heating portion, wherein the second conveying path is joined downstream of the discharge path.

5. A glossiness processing apparatus according to claim 1, further comprising a cutter mechanism configured to cut the sheet which is heated in the second heating portion.

6. A glossiness processing apparatus according to claim 1, wherein the second heating portion includes a pair of heating rollers for heating and pressing the sheet guided by the first conveying path, a downstream side roller provided downstream of the pair of heating rollers, and an endless belt wound around one of the pair of heating rollers and the downstream side roller, and the pair of heating rollers heat and press the sheet guided by the first conveying path while pushing the surface on which the toner image is transferred against the endless belt.

7. A glossiness processing apparatus according to claim 6, further comprising a cooling portion is provided along the endless belt wherein the sheet which is heated by the pair of heating rollers is cooled by the cooling portion.

8. A glossiness processing apparatus according to claim 7, wherein a delivery and receipt portion of the sheet with respect to the first conveying path is set at a position higher than a delivery and receipt portion of the sheet with respect to the second conveying path in the second heating portion, and the cooling portion is placed below the pair of heating rollers.

9. A glossiness processing apparatus according to claim 1, wherein the first heating portion is provided in an image forming apparatus main body, the first conveying path, the second heating portion, and the second conveying path are formed into an integrated unit; and the unit is detachably attachable to the image forming apparatus main body.

10. An image forming apparatus, comprising:

an image forming portion configured to transfer a toner image on the sheet;

a first heating portion configured to heat a sheet with a toner image transferred on the sheet by the image forming portion;

a second heating portion configured to heat the sheet which is heated in the first heating portion;

a first conveying path configured to guide the sheet which is heated in the first heating portion to the second heating portion; and a second conveying path configured to guide the sheet from the second heating portion downstream, wherein the first conveying path, the second heating portion, and the second conveying path are arranged from above downward in order of mention, the second conveying path has a curved guide surface and the second conveying path ends at a position below the second heating portion, and when the sheet which is heated in the second heating portion is guided by the second conveying path, the sheet is guided so that a surface opposite to a surface on which the toner image is transferred moves along the curved guide surface.

11. A glossiness processing apparatus, comprising:

a first heating portion configured to heat a sheet with a toner image transferred on the sheet;

a second heating portion configured to heat the sheet which is heated in the first heating portion;

a first conveying path configured to guide the sheet which is heated in the first heating portion to the second heating portion; and a second conveying path configured to guide the sheet from the second heating portion downstream, wherein the first conveying path, the second heating portion, and the second conveying path are arranged from above downward in order of mention, the second conveying path has a curved guide surface, and when the sheet which is heated in the second heating portion is guided by the second conveying path, the sheet is guided so that a surface opposite to a surface on which the toner image is transferred moves along the curved guide surface, and wherein the first conveying path, the second heating portion, and the second conveying path form a sheet conveying S-shaped path.

12. A glossiness processing apparatus according to claim 11, further comprising a discharge path that is branched upstream of the first conveying path, and conveys the sheet fixed in the first heating portion without allowing the sheet to pass through the second heating portion, wherein the second conveying path is joined downstream of the discharge path.

13. A glossiness processing apparatus according to claim 11, further comprising a cutter mechanism configured to cut the sheet which is heated in the second heating portion.

14. A glossiness processing apparatus according to claim 11, wherein the second heating portion includes a pair of heating rollers for heating and pressing the sheet guided by the first conveying path, a downstream side roller provided downstream of the pair of heating rollers, and an endless belt wound around one of the pair of heating rollers and the downstream side roller, and the pair of heating rollers heat and press the sheet guided by the first conveying path while pushing the surface on which the toner image is transferred against the endless belt.

15. A glossiness processing apparatus according to claim 14, further comprising a cooling portion is provided along the endless belt, wherein the sheet which is heated by the pair of heating rollers is cooled by the cooling portion.

16. A glossiness processing apparatus according to claim 15, wherein a delivery and receipt portion of the sheet with respect to the first conveying path is set at a position higher than a delivery and receipt portion of the sheet with respect to the second conveying path in the second heating portion, and the cooling portion is placed below the pair of heating rollers.

17. A glossiness processing apparatus according to claim 11, wherein the first heating portion is provided in an image forming apparatus main body, the first conveying path, the second heating portion, and the second conveying path are formed into an integrated unit; and the unit is detachably attachable to the image forming apparatus main body.

18. An image forming apparatus, comprising:

an image forming portion configured to transfer a toner image on the sheet;

a first heating portion configured to heat a sheet with a toner image transferred on the sheet by the image forming portion;

a second heating portion configured to heat the sheet which is heated in the first heating portion;

a first conveying path configured to guide the sheet which is heated in the first heating portion to the second heating portion; and a second conveying path configured to guide the sheet from the second heating portion downstream, wherein the first conveying path, the second heating portion, and the second conveying path are arranged from above downward in order of mention, the second conveying path has a curved guide surface, and when the sheet which is heated in the second heating portion is guided by the second conveying path, the sheet is guided so that a surface opposite to a surface on which the toner image is transferred moves along the curved guide surface, and wherein the first conveying path, the second heating portion, and the second conveying path form a sheet conveying S-shaped path.

* * * * *